US006991840B2

(12) United States Patent
Sosalla

(10) Patent No.: US 6,991,840 B2
(45) Date of Patent: Jan. 31, 2006

(54) SEPARABLY JOINED RELATIONSHIP BETWEEN ADJOINING WIPES

(75) Inventor: Gerald Keith Sosalla, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 102 days.

(21) Appl. No.: 10/733,600

(22) Filed: Dec. 10, 2003

(65) Prior Publication Data

US 2005/0129898 A1 Jun. 16, 2005

(51) Int. Cl.
*B32B 3/10* (2006.01)

(52) U.S. Cl. ..... 428/43

(58) Field of Classification Search ..... 428/43
See application file for complete search history.

(56) References Cited

U.S. PATENT DOCUMENTS

| | | | | |
|---|---|---|---|---|
| 459,516 | A * | 9/1891 | Wheeler | 428/43 |
| 4,100,324 | A | 7/1978 | Anderson et al. | |
| 4,478,354 | A | 10/1984 | Notheis | |
| 4,570,518 | A | 2/1986 | Burmeister et al. | |
| 4,627,117 | A | 12/1986 | Morishita | |
| 4,700,939 | A | 10/1987 | Hathaway | |
| 4,721,295 | A | 1/1988 | Hathaway | |
| 5,041,317 | A | 8/1991 | Greyvenstein | |
| 5,114,771 | A | 5/1992 | Ogg et al. | |
| 5,205,454 | A | 4/1993 | Schutz et al. | |
| 5,496,605 | A | 3/1996 | Augst et al. | |
| 5,562,964 | A | 10/1996 | Jones | |
| 5,616,387 | A | 4/1997 | Augst et al. | |
| 5,704,566 | A | 1/1998 | Schutz et al. | |
| 6,010,090 | A | 1/2000 | Bushmaker et al. | |
| 6,029,921 | A | 2/2000 | Johnson | |
| 6,228,454 | B1 | 5/2001 | Johnson et al. | |
| 6,368,689 | B1 | 4/2002 | Connor Sledge et al. | |
| 6,548,136 | B1 | 4/2003 | Piccini et al. | |
| 2002/0121172 | A1 | 9/2002 | Lanvin et al. | |

FOREIGN PATENT DOCUMENTS

| | | | |
|---|---|---|---|
| EP | 1 023 863 | A1 | 8/2000 |
| EP | 0 958 200 | B1 | 4/2002 |
| WO | WO 01/03563 | A1 | 1/2001 |
| WO | WO 01/82763 | A1 | 11/2001 |
| WO | WO 02/053365 | A2 | 7/2002 |
| WO | WO 02/058524 | A2 | 8/2002 |
| WO | WO 02/086255 | A1 | 12/2002 |
| WO | WO 02/098268 | A1 | 12/2002 |
| WO | WO 03/034885 | | 5/2003 |
| WO | WO 03/053203 | A1 | 7/2003 |

* cited by examiner

*Primary Examiner*—Alexander S. Thomas
(74) *Attorney, Agent, or Firm*—Michael J. Bendel; Scott A. Baum

(57) ABSTRACT

The invention relates to a group of wipes. The group of wipes includes at least three wipes separably joined together, each wipe separable joined to each adjacent wipe by a weakened line. Each weakened line includes a plurality of first-type weakened zones and at least one second-type weakened zone. The second-type weakened zone has a length that is at least 1.5 times a length of the first-type weakened zone and the second-type weakened zone is randomly positioned along the weakened line such that no two consecutive weakened lines have the second-type weakened zone in the same position relative to opposite ends of consecutive weakened lines.

19 Claims, 9 Drawing Sheets

SEPARABLY JOINED RELATIONSHIP BETWEEN ADJOINING WIPES

BACKGROUND OF THE INVENTION

Wipes have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. In an alternative configuration, the wet wipes have been placed in the container in the form of a continuous web of material which includes perforations to separate the individual wet wipes and which can be wound into a roll. Such wet wipes have been used for baby wipes, hand wipes, household cleaning wipes, industrial wipes and the like.

The conventional packages which contain wipes, such as those described above, have typically been designed to be positioned on a flat surface such as a countertop, changing table or the like. Such conventional packages have generally provided a plastic container, tub or package which provides a sealed environment for the wet wipes to ensure that they do not become overly dry. Some of the conventional packages have also been configured to provide one at a time dispensing of each wet wipe which can be accomplished using a single hand after the package has been opened. Such single handed, one at a time dispensing, often referred to as "pop-up" dispensing, is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a baby wipe to clean the infant.

However, the dispensing of wipes from such conventional containers for wipes has not been completely satisfactory. For example, this is due at least in part to the configuration of the stack of wipes within the container. In particular, for example, this concerns the relationship of each wipe in the stack to each adjacent wipe in the stack. As another example, this can concern the relationship of a group of wipes in the stack to other wipes in the stack if groups of wipes make up the stack of wipes. As yet another example, these relationships between wipes concern, in conjunction with the wipes, the container from which the wipes are dispensed and characteristics thereof.

SUMMARY OF THE INVENTION

In response to the difficulties and problems discussed above, for example, a new relationship between two adjacent sheets or wipes, enabling improved dispensing, and which may be more cost effective and reliable (e.g., reducing the likelihood of wipe fallback and/or reducing the likelihood of multiple wipes dispensing undesirably), has been invented. For example, dispensing can be improved or made easier when a wipe is ready for dispensing upon the opening of a resealable wipes dispenser after the initial opening of the dispenser and use of a first wipe in a plurality of wipes. That is, a portion of the wipe is positioned in a restrictive orifice of the dispenser sufficiently protruding so a user can readily grasp the same and remove the entire individual wipe without premature tearing or non-dispensing of the top wipe. As another example, "wipe fallback" can occur when a leading wipe in a plurality of wipes separates completely from a following or trailing wipe prematurely, i.e., before a sufficient portion of the following wipe is positioned within the dispenser orifice to remain there for later dispensing after the leading wipe is fully separated or disjointed from the trailing wipe outside the dispenser. In such a fallback situation, the following wipe would need to be re-threaded through the dispensing orifice when its dispensing is next desired. This may not be undesirable if done intentionally, i.e., if maintaining a maximum moisture level for the sheets is desired, e.g., for wet wipes, and if the dispensing orifice is designed to easily accommodate reach-in retrieval of the next sheet. As yet another example, "multiple wipes" dispensing can occur when a leading individual wipe in a plurality of wipes does not timely separate completely from a following individual wipe while the following wipe is still at least partially maintained in the dispensing orifice, i.e., the following wipe dispenses completely out of the dispenser with the leading wipe causing two (or more) wipes to dispense substantially simultaneously. This can be desirable when two (or more) wipes are needed, but if only one is desired, then this is not preferred.

The purposes and features of the present invention will be set forth in and are apparent from the description that follows, as well as will be learned by practice of the invention. Additional features of the invention will be realized and attained by the product and processes particularly pointed out in the written description and claims hereof, as well as from the appended drawings.

In one aspect, the invention provides a group of wipes. The group of wipes includes at least three wipes separably joined together, with each wipe separable joined to each adjacent wipe by a weakened line. Each weakened line includes a plurality of first-type weakened zones and at least one second-type weakened zone. The second-type weakened zone has a length that is at least 1.5 times a length of the first-type weakened zone and the second-type weakened zone is randomly positioned along the weakened line such that no two consecutive weakened lines have the second-type weakened zone in the same position relative to opposite ends of the consecutive weakened lines.

In another aspect, the invention provides a group of wipes for use in a pop-up wipes system. The system includes a pop-up dispenser having a restrictive orifice through which wipes can be dispensed. Within the system is a group of wipes which includes at least three wipes separably joined together, each wipe separable joined to each adjacent wipe by a weakened line. Each weakened line includes a plurality of first-type weakened zones and at least one second-type weakened zone. The second-type weakened zone has a length that is at least 1.5 times a length of the first-type weakened zone and the second-type weakened zone is randomly positioned along the weakened line such that no two consecutive weakened lines have the second-type weakened zone in the same position relative to opposite ends of the consecutive weakened lines.

In still another aspect, the invention provides a process for making the group of wipes. The process includes providing an elongate web of material. The web of material is then weakened along a plurality of lines to define a plurality of panels consecutively releasably joined together by a weakened line. The panels are then formed into a group of wipes which includes at least three wipes separably joined together by respective weakened lines such that the weakened line between the adjoining wipes includes a plurality of first-type weakened zones and at least one second-type weakened zone, with the second-type weakened zone having a length at least two times a length of the first-type weakened zones. Further, the second-type weakened zone is randomly positioned along the weakened line such that no two consecutive wipes of the group have weakened lines with the second-type weakened zone in the same position relative to opposite ends of the weakened lines of the consecutive wipes.

In yet other aspects, the invention provides a dispensing system for a group of wipes in a pop-up wipes system. The system includes a dispenser having a base and a top enclosing an interior. A stack of fan folded material can be stored in the interior, with the top including an opening through which the wipes can pass to an external position outside the dispenser. The stack of fan folded material includes at least one group of separably joined wipes.

In yet other aspects, the invention provides various configurations for the weakened line, the wipes per se, and the wipes relative to other wipes such as in a stack of wipes.

In still other aspects, the invention is provided for use in various types of dispensers and for dispensing in various manners such as reach-in dispensing and pop-up dispensing.

As used herein, the term "machine direction" or MD means the length of a fabric or material in the direction in which it is being converted. The term "cross machine direction" or CD means the width of fabric, i.e. a direction generally perpendicular to the MD.

As used herein, sheets of the invention are considered "separably joined", "separably joining" (and variations thereof when each sheet of a plurality, e.g., in a stack of sheets, is engaging any adjacent sheet while in the dispenser or package such that withdrawing the leading sheet through the dispenser or package opening also withdraws at least a portion of the following sheet through the opening before the leading sheet and the following sheet separate completely from each other. Such engaging of any adjacent sheet can include an interfolded relationship or a non-interfolded relationship in combination with one or more of the following between adjacent sheets: adhesive, friction, adhesion, fusion bonding (e.g., ultrasonic welding, heat sealing), mechanical entanglement (e.g., needle punching, steam sealing, embossing, crimping), autogeneous bonding, and/or weakened line(s) (e.g., perforations, zones of frangibility, score line(s), crush cutting).

As used herein, "perforation" means the amount of cutting and the distance between the cuts in the perforation that separates the sheets in a group. There are three parameters to this measurement: cut length, bond length and bond spacing. The bond spacing is equal to the sum of the cut length plus the bond length. By way of example, perforations that are useful with sheets, e.g., wet wipes of the invention, are ones that have a bond length in the range of 0.070 inch (1.75 mm) to 0.010 inch (0.25 mm), a cut length for the first-type weakened zone in the range of 0.055 inch (1.375 mm) to 0.74 inch (18.50 mm), a cut length for the second-type weakened zone which corresponds to at least 1.5 times the cut length of the first-type weakened zone. Ultimately, however, desired perforation configurations are dependent upon many factors including basesheet characteristics (e.g., fiber composition, formation process, bulk, density, thickness, weight, CD tensile, MD tensile), desired dispensing characteristics (e.g., type of dispensing, type of dispenser, wet or dry dispensing) and others that can affect how one sheet separates from another sheet and/or dispenses from a dispenser. As used herein, when the following sheet that has at least a portion through the opening of the dispenser or package is intentionally maintained in the opening after the leading sheet is completely separated from the following sheet, this is referred to as "pop-up" format or dispensing. To be intentionally maintained in the opening means the opening is configured to so maintain the sheet therein, such as through use of a restrictive or constricting opening or opening being smaller than the sheet in at least one dimension of the sheet.

As used herein, "reach-in" dispensing is understood to mean having to fetch a wipe out of a container through an opening substantially co-extensive with the walls of the container or through a restricted opening smaller than the perimeter defined by the walls. In either case, the top wipe for dispensing rests on top of the remainder of the stack of wipes and the top wipe needs to be separated from the remainder of the stack each time anew when dispensing is desired. An example of a reach-in dispenser is found in the currently available baby wipes product sold by Kimberly-Clark Corporation of Neenah, Wis. under the trade name HUGGIES® Supreme Care.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the wipes of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts depicted in the drawings are referred to by the same reference numerals.

DETAILED DESCRIPTION OF THE INVENTION

Figure 1:
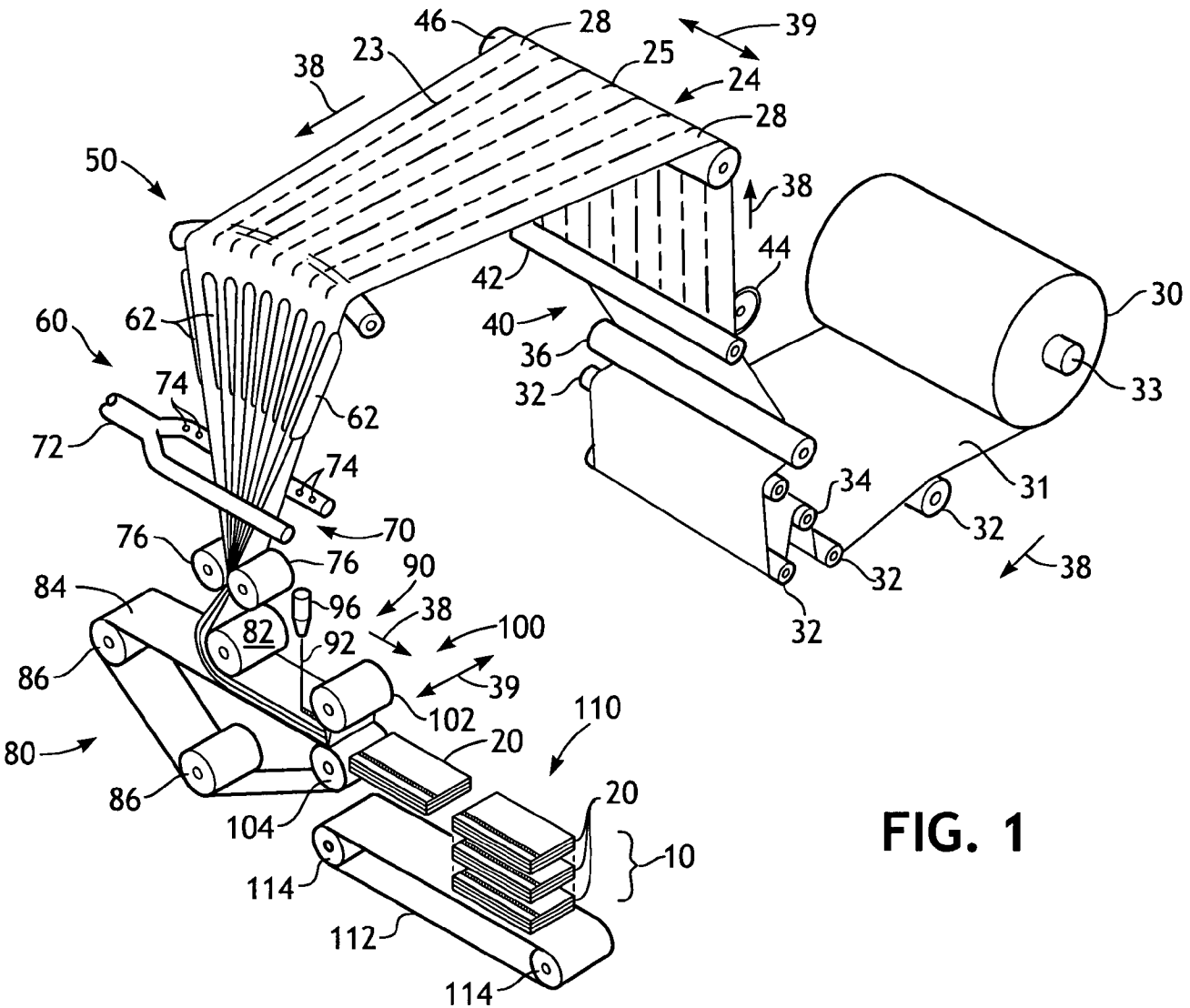
FIG. 1 representatively shows a schematic view of an apparatus and process for forming a stack of fan folded material including a group of wipes, in accordance with the present invention.

As representatively illustrated throughout the figures, and for explanation now referring to FIG. 1, there is depicted an apparatus and process for making a stack 10 of a plurality of separably joined wipes from fan folded material. Starting on the right side of FIG. 1, there is a roll 30 of basesheet material 31. The roll can be supported by a roll support 33. The material is fed from the roll 30 through a series of advancing rollers such as idler rollers 32 and dancer roller 34. From there the web of material 31 travels to a slitter assembly 40. The slitter assembly can include an anvil roller 42 and slitting blades 44 that form weakened lines 24 (e.g., perforated slitting blades that thereby form perforations 25 and 23) in the sheet as it travels in the machine direction 38 through the slitting assembly. As a result of traveling through the slitting assembly, the web is formed into a plurality of panels 28 joined to adjacent panels along the plurality of weakened lines 24. From there the sheet travels over an upper idler roller 46 and over to an arched roller assembly 50. The web then travels into the folding assembly 60. The folding assembly includes a series of folding boards 62 that assist in necking down the web in the cross direction 39 in a controlled fashion to induce machine direction 38 folds.

As the web travels down the folding assembly 60, it can encounter a moistening assembly 70. Assembly 70 can include a bar 72 having ports 74 for imparting liquid or solution onto the moving web as it is necked down into a fan folded ribbon of material. A liquid or solution can be provided at a desired add-on rate and in a conventional manner to the bar 72 so it can be applied through ports 74 to the moving web. Such application could include spraying or drooling with a bar like 72, or could include alternate structures (not shown) for techniques such as printing, a bath, a flooded nip, or hollowed out folding boards with spray orifices that project fluid in a rather even horizontal plane as the web moves by the boards. Alternatively, if a dry final product is desired the moistening assembly can be eliminated and otherwise the manufacturing apparatus and process could be the same. As the web travels further down the folding assembly, the sheet becomes corrugated to a point where the web is compressed in the cross direction by means of nip rollers 76. At this point, the web forms a single ribbon of fan folded sheets that then travels by a conveyor assembly 80 including a pull roller 82, support belt 84 and support rollers 86 which are an idler roller and a drive roller. The web continues travel to an adhesive application assembly 90. The adhesive assembly applies adhesive 92 via an adhesive nozzle 96 to the top of the ribbon, e.g., along an edge. Adhesive can be applied by various techniques known to those of skill in the art. For example, when the sheets comprise wet wipes, some such ways are described in a U.S. patent application entitled, "PROCESS FOR JOINING WET WIPES TOGETHER AND PRODUCT MADE THEREBY" of inventors Yung H. Huang et al., U.S. Ser. No. 09/870,815, assigned to the same assignee of this application and also known as WO 02/098268, which application is incorporated herein by reference.

The ribbon with adhesive applied thereto travels on to a cutter assembly 100, which includes a rotary cutter 102 and anvil roller 104. The ribbon is then cut into discreet pieces, called clips 20, which then pass to a stacker assembly 110. The stacker assembly includes a stacker belt 112 and stacker rollers 114 which are an idler roller and a drive roller. In the stacker assembly 110, the clips 20 are stacked one upon the other and thereby the adhesive 92 on the top sheet of a clip adheres to a bottom sheet of the subsequent clip that is stacked on top of it, to form a stack 10 of wipes. A desired number of clips are stacked one on top of another and adhesively joined in this manner to form stack 10. An example of such an apparatus for use as the stacker assembly is provided with a variety of conventional wet wipe machines sold by Paper Converting Machine Company of 2300 S. Ashland Ave., Green Bay, Wis. 54307, under the tradename Triton™ Wet Wipes Machine or tradename Clipper™ Series Rx 300CW wipes folder. Other stackers that could be employed are those supplied with a ZFV™ folder, sold by Elsner Engineering of Hanover, Pa. USA or a Serv-O-Tec™ folder sold by Serv-O-Tec in Lagenfeld Germany (Serv-O-Tec is a division of Bretting Mfg. in Ashland Wis., USA). Then, the completed stack is moved to a packaging assembly (not shown) where the clips can be put in various types of dispensers (e.g., tubs, bags, etc.) and then made ready for commercial sale and use. For a further understanding of representative apparatus and process seen in FIG. 1, see WO 02/096255, entitled "STACK OF FAN FOLDED MATERIAL AND COMBINATIONS THEREOF", published Dec. 5, 2002.

Figure 2:
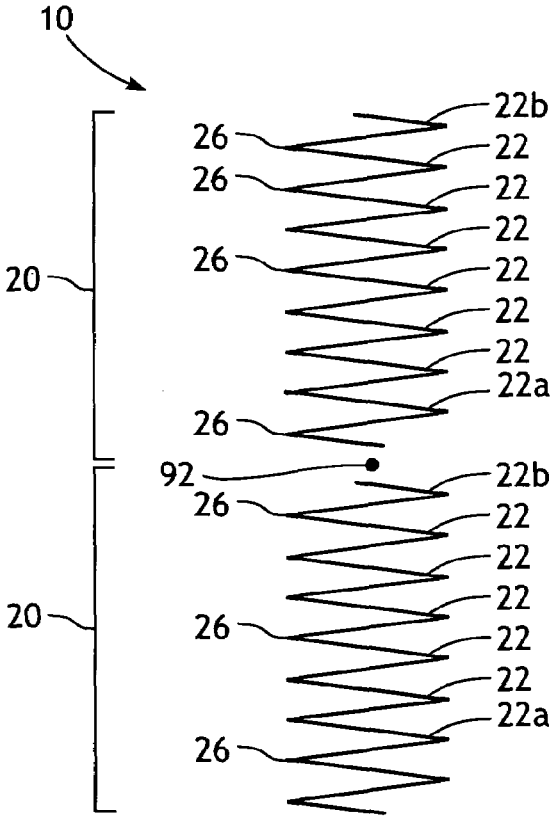
FIGS. 2, 2B, 2C and 3 representatively show schematic side views of clips of fan folded sheets, in accordance with the present invention.
Figure 3A:
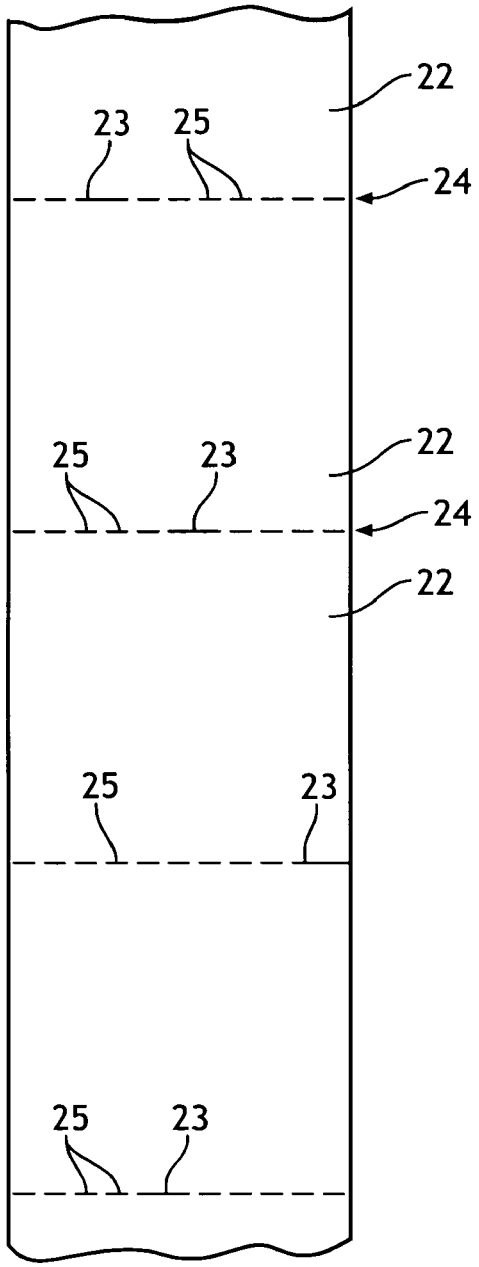
Figure 3:
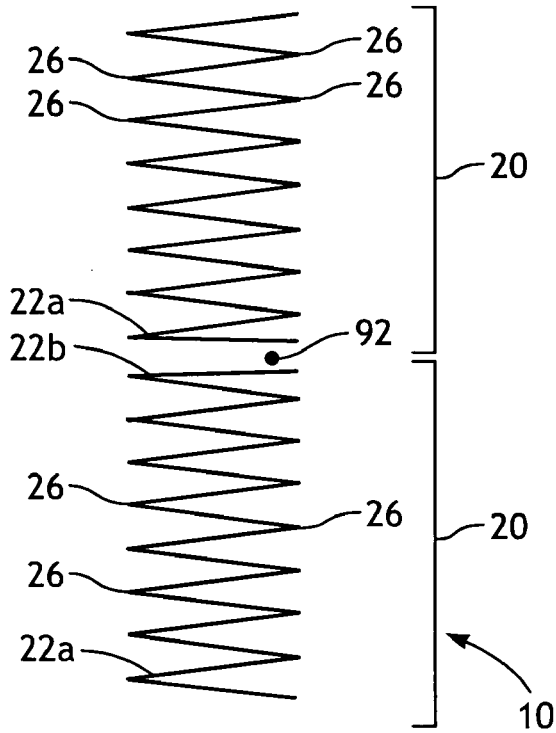

Generally, and referring to FIGS. 2 to 3A, inclusive, the invention relates to a stack 10 of at least one group of wipes where each group comprises at least three sheets 22 separably joined to each adjacent sheet by a weakened line 24. The weakened line may be a straight line, or it could take on other configurations that extend from one side of the wipe sheet to the other. Each weakened line 24 includes a plurality of first-type weakened zones 25 and at least one second-type weakened zone 23. The second-type weakened zone has a length that is at least 1.5 times a length of the first-type weakened zone. Further, depending on the desired separation characteristics of two adjoining sheets during dispensing (as discussed further hereinafter), it may be advantageous, though not required, to have the length of the second-type weakened zone be at least two times, at least three times or at least four times, greater than the length of the first-type weakened zone. The second-type weakened zone is randomly positioned along the weakened line 24 such that no two consecutive weakened lines 24 have the second-type weakened zone 23 in the same position relative to opposite ends of the consecutive weakened lines 24. The depicted zones 23 and 25 are not drawn to any scale but their relative dimensions are important as discussed herein.

Without being limited to a theory of operation, such a second-type weakened zone is believed to be advantageous to provide more consistent and reliable pop-up format dispensing as compared to a weakened line with only one type of weakened zone, such as first-type zones 25. Such zone 23 can provide a discrete separation point along weakened line 24 to assist in (i) initiating separation of two adjoining wipes or sheets or (ii) concluding separation more consistently as the second-type weakened zone passes through a restrictive orifice if separation is not yet complete (i.e., when zone 23 is subjected to high dispensing forces due to direct contact of the sheet with the dispensing orifice adjacent the zone 23) or (iii) maintaining wipe separation as it propagates across the weakened line during dispensing of the wipe. Yet a further advantage can be an expanded operating window for manufacturing the subject wipes.

Particularly, by implementing a randomization result, there is not the costly, and often also difficult, task of insuring that the second-type weakened zone stays in registration with the group of wipes during formation. Consequently, such enables, but does not require, the ability to advantageously attain a second-type weakened zone feature in each weakened line 24 for enhanced pop-up dispensing, but with lower cost manufacturing equipment and processing.

Figure 8:
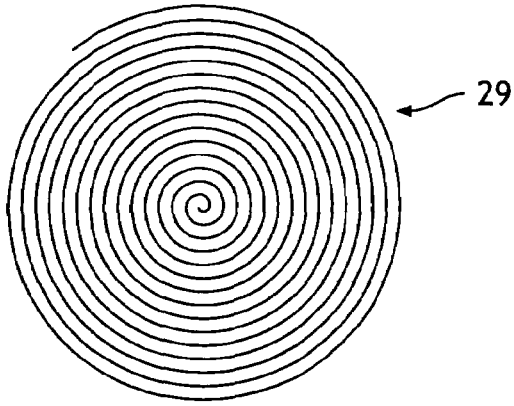
FIG. 8 representatively shows an alternate form of sheets, in accordance with the present invention.
Figure 2A:
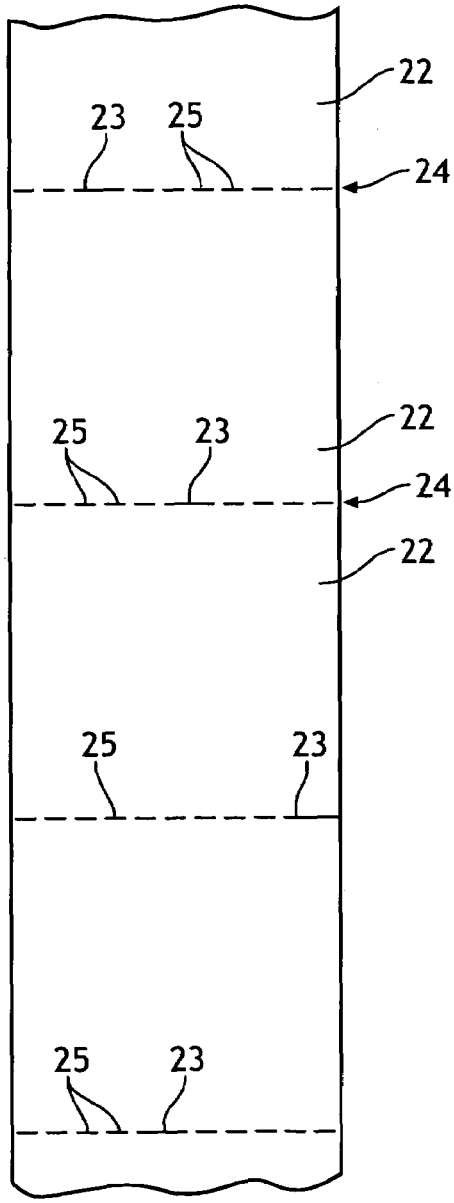
FIGS. 2A and 3A representatively show schematic top views of a portion of the sheets of FIGS. 2 and 3, respectively, and in a non-fan folded position.
Figure 2C:
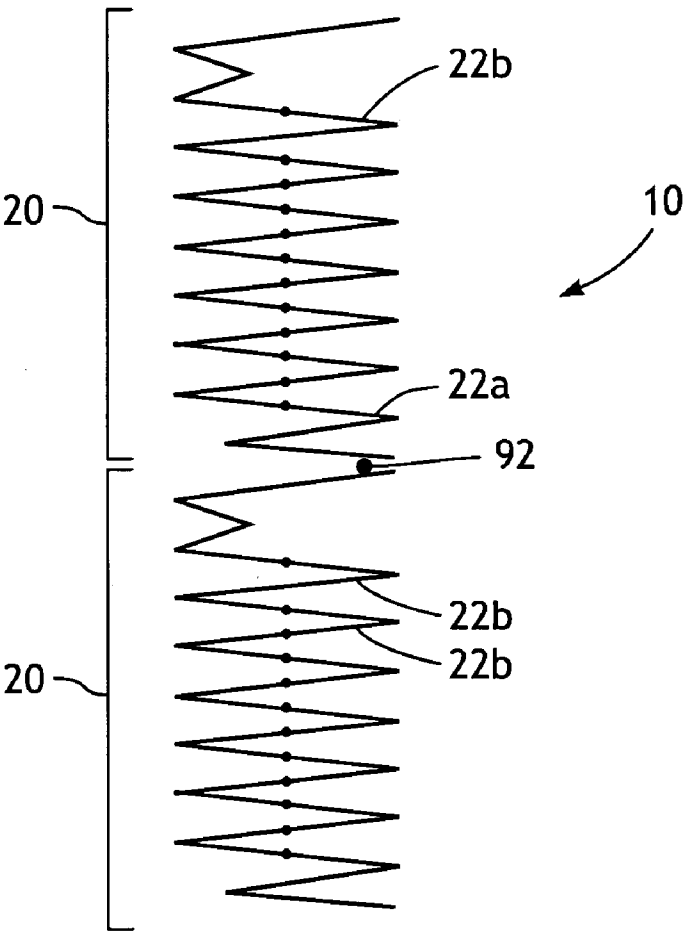
Figure 2B:
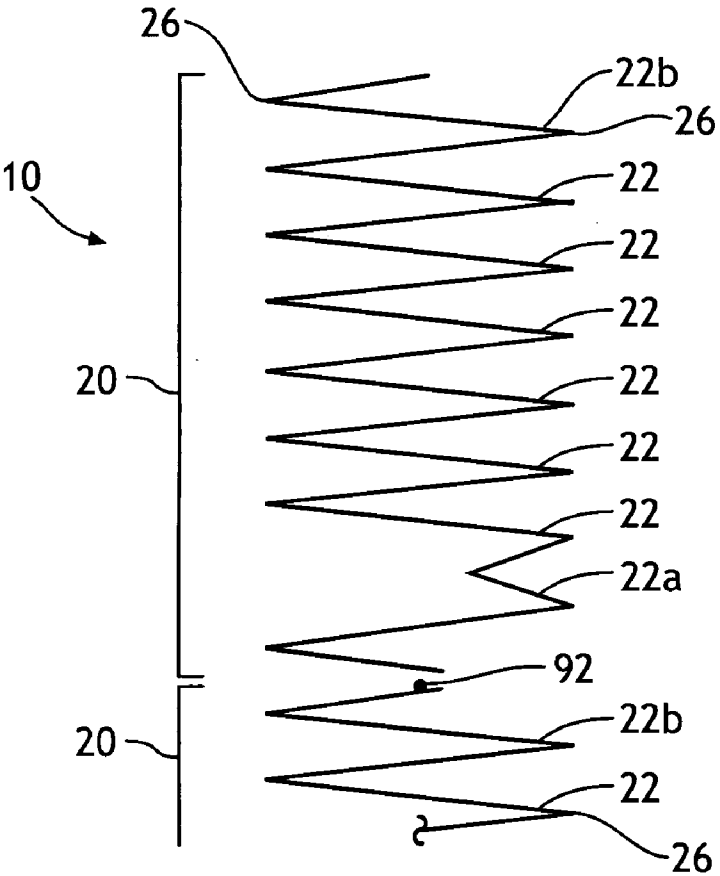
Figure 5:
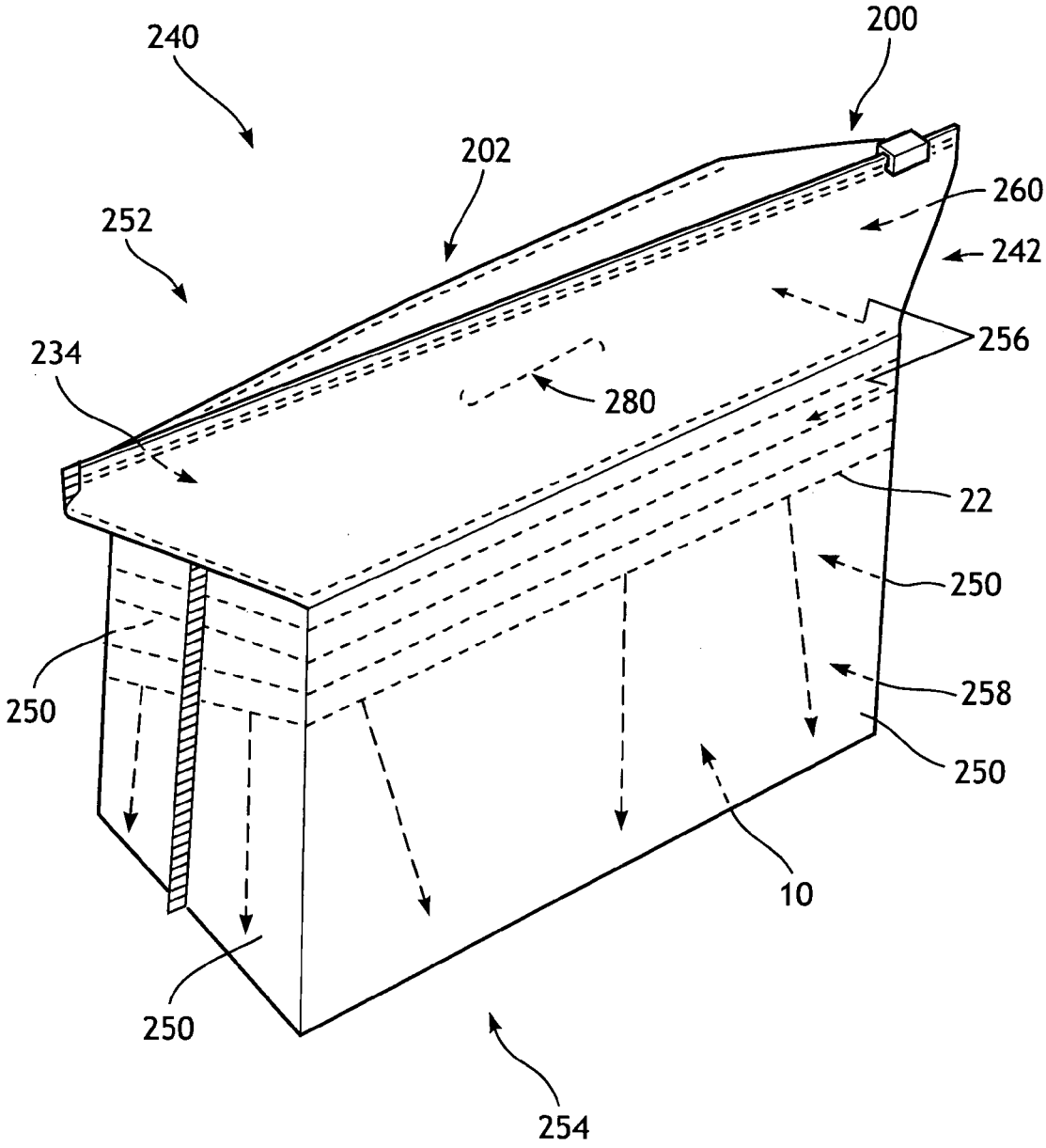
FIG. 5 representatively shows a perspective view of a type of non-rigid dispenser for use with wipes of the present invention, where wipes are sealed therein and the dispenser is closed.
Figure 6:
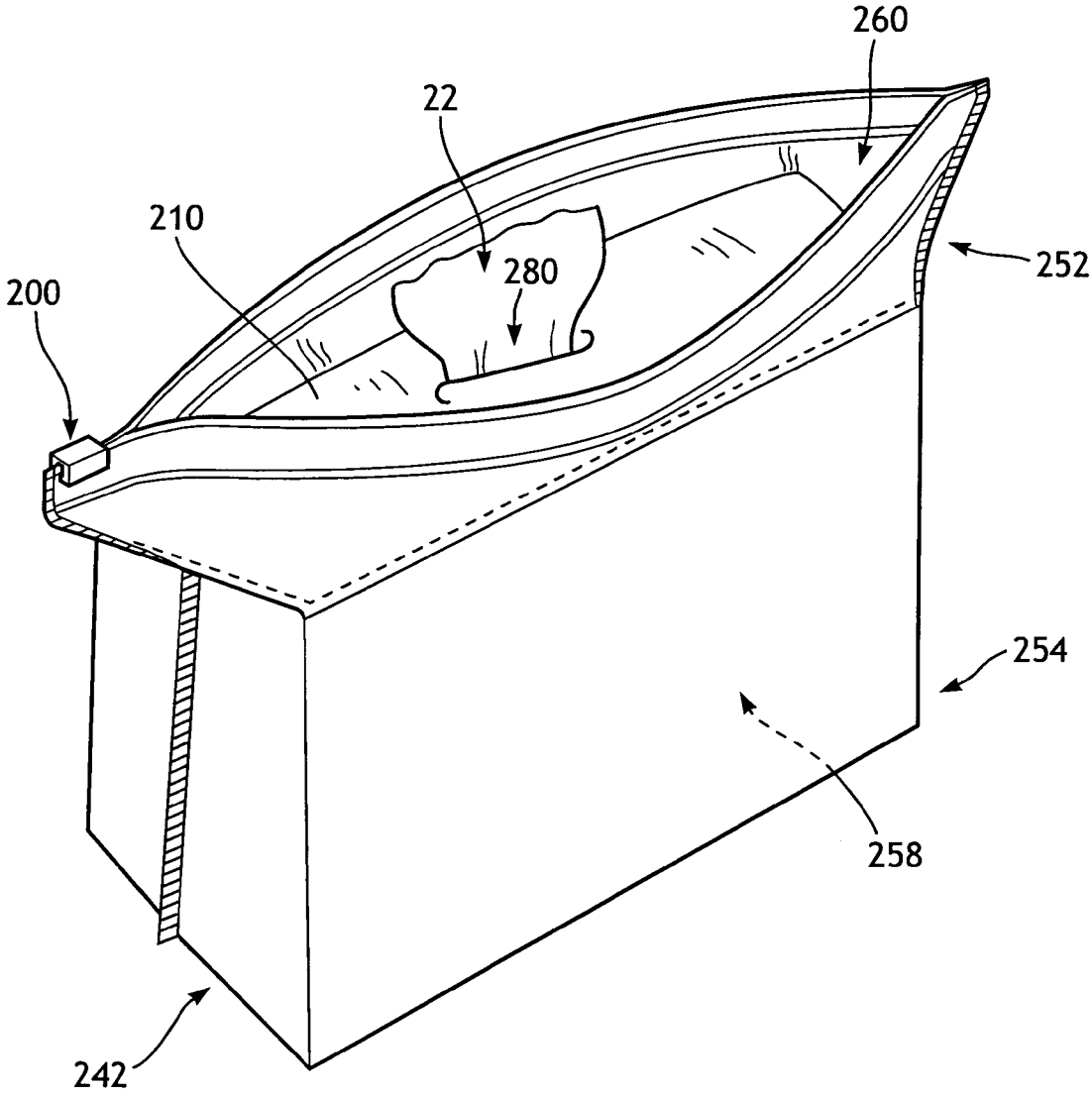
FIG. 6 representatively shows a perspective view of the dispenser of FIG. 5, where a wipe is ready for pop-up dispensing and the dispenser is open.
Figure 7:
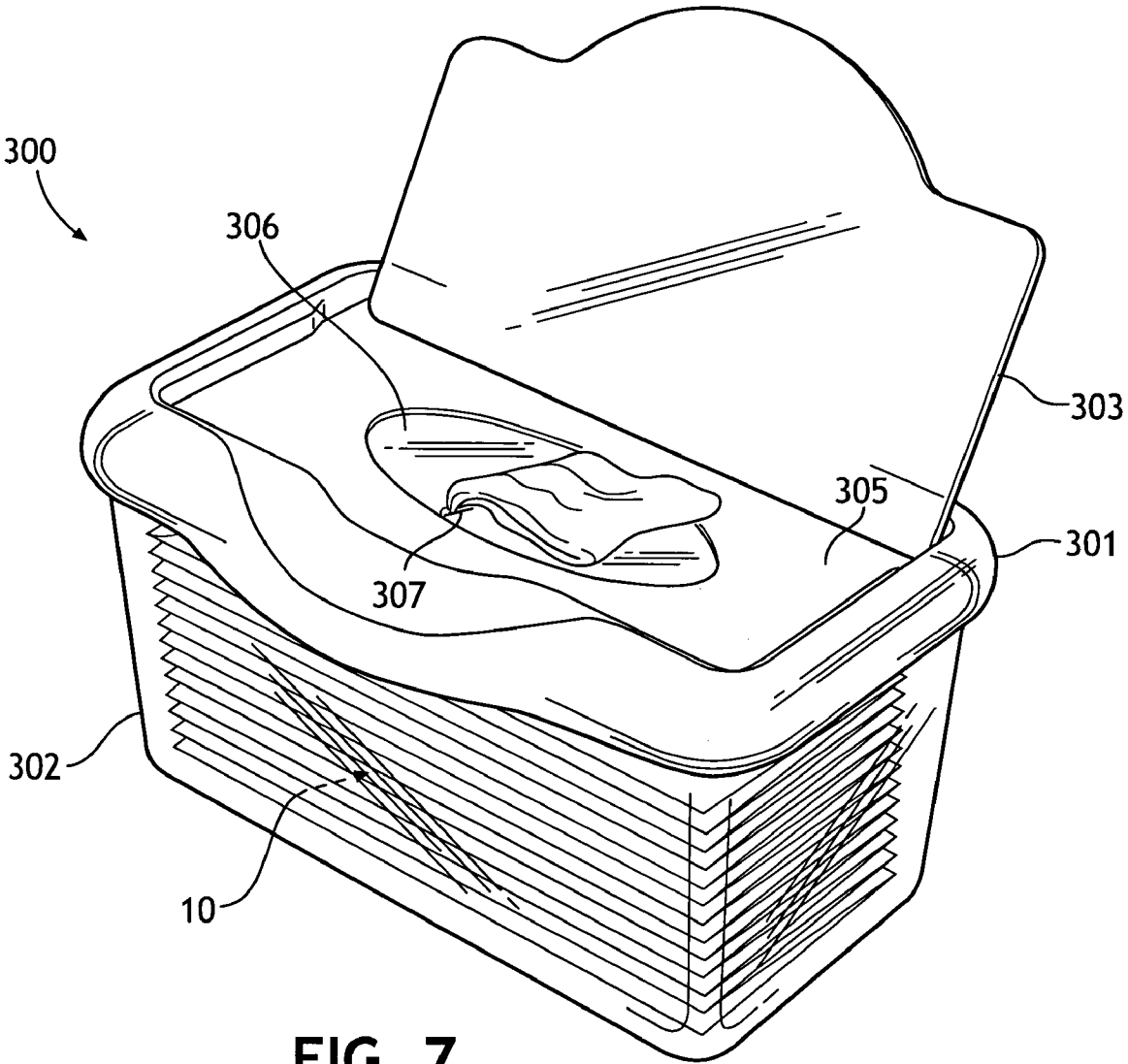
FIG. 7 representatively shows a perspective view of a type of rigid dispenser for use with wipes of the present invention, where wipes are sealed therein and the dispenser top is open.

The group of wipes may be formed into a stack 10 of wipes, and such used in combination with a wipes dispenser, such as a pop-up wipes system 240 or 300 (e.g., discussed herein and seen in FIGS. 5–7). The stack of wipes may be formed from at least two clips 20 of fan folded material. Each clip 20 maybe separably joined to an adjacent clip, e.g., advantageously by the last sheet 22*a* of one clip being joined to the first sheet 22*b* of a succeeding clip. Stacks of fan folded material within the scope of the invention can have any sheet in one clip joined to any sheet in a succeeding clip as long as dispensing of sheets from a preceding clip dispenses simultaneously at least one sheet of a succeeding clip so as to continue successive dispensing of the entire stack 10, as desired. The sheets 22 in FIG. 3 are also a plurality of individual sheets like those in FIG. 2, although each sheet is not separately numbered as in FIG. 2. The sheets 22 in FIG. 2B are also a plurality of individual sheets like those in FIG. 2. The small dots seen in a vertical line on the wipes in FIG. 2C merely represent weakened lines such as lines 24 seen in FIGS. 2A and 3A. As seen in FIGS. 2A and 3A, a top view of a portion of the sheets in the clips shows the individual sheets of the clips can be separably joined together along weakened lines 24, such as lines of perforations 23 and 25, to ensure that the trailing sheet is in position for grasping by a user after the leading sheet is removed. Generally, the portion of the web of material between successive weakened lines defines each individual sheet. Folds 26, which are formed in the machine direction, generally define the width of the clip except for a situation like sheets 22*a* and the adjacent sheet in the full clip seen in FIG. 2B. In use, the invention can be dispensed in the so-called pop-up format so that once the first sheet of the stack of fan folded sheets is dispensed through a dispenser orifice, each succeeding sheet will be at least partially pulled through the dispensing orifice before the leading sheet is fully separated from the succeeding sheet, as desired. That is, each sheet within the stack is separably joined to an adjacent sheet by either a weakened line relationship or an adhesive relationship, thus enabling, as desired, one-after-another dispensing for the entire stack once the initial sheet is dispensed. Alternatively, the invention could be used for so-called reach-in dispensing, and the user would have to actively assist in separating the lead sheet from the succeeding sheet each time dispensing is desired. Still alternatively, the group of wipes may be formed into a roll of wipes, as in FIG. 8.

Figure 4A:
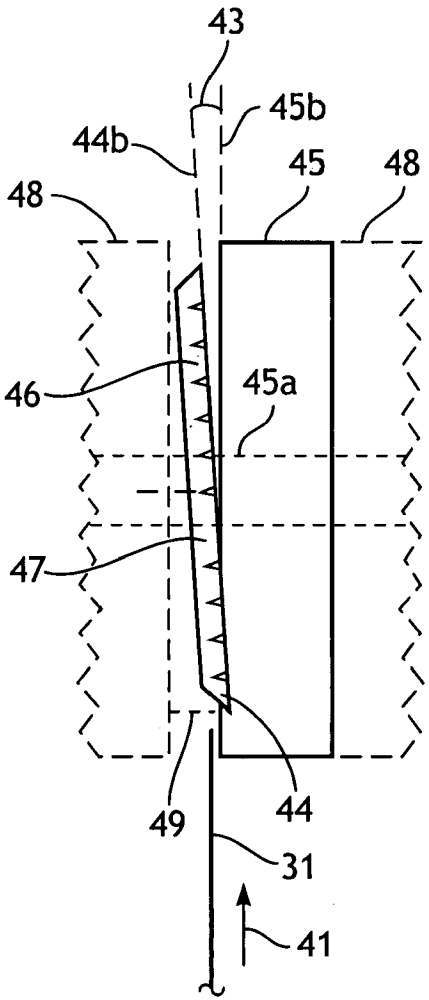
FIG. 4A representatively shows an edge view of the pair of shear slitters in FIG. 5.
Figure 4:
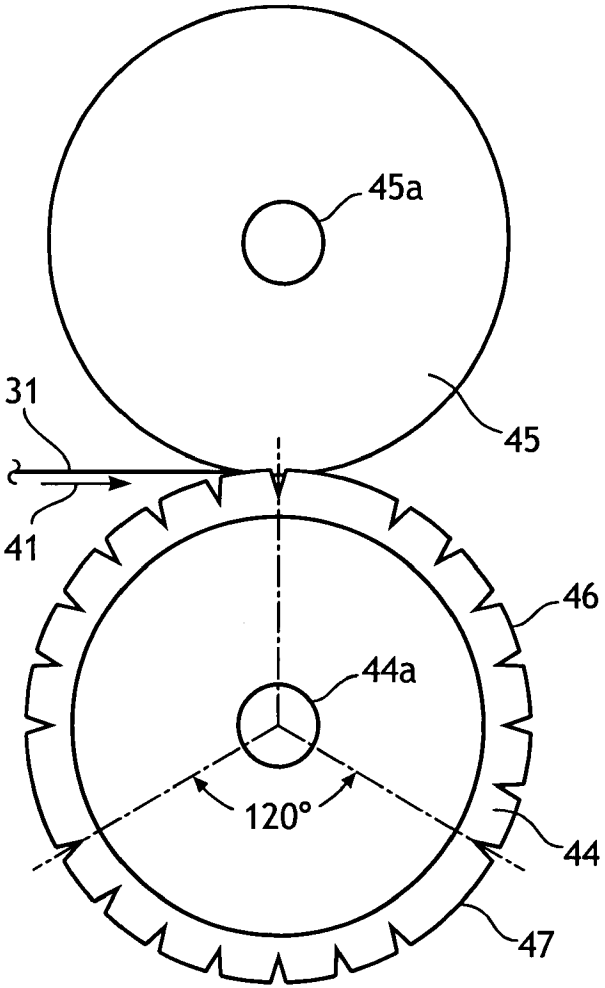
FIG. 4 representatively shows a side view of a pair of shear slitters for use with the present invention.

FIGS. 4 and 4A illustrate features for the slitter assembly 40, which can include pairs of shear slitters (i.e., one pair for each machine direction weakened line desired in the sheet of material), each pair including a perforated slitting blade 44 and a shear anvil 45. The basesheet material 31 can travel in the direction 41 through the slitter assembly. The perforated slitting blade seen in FIGS. 4 and 4A could be used in combination with the anvil roller 42 seen in FIG. 1 (i.e., one blade 44 for each machine direction weakened line desired in the sheet of material, and this combination often referred to as crush or score slitting) to thereby form a weakened line (e.g., of perforations) in the web of material traveling between the slitting blades 44 and anvil roller 42. Alternatively, anvil 45 seen in FIGS. 4 and 4A could be positioned opposite perforated slitting blades like blade 44 to thereby form a weakened line (e.g., of perforations) in the web of material traveling between the perforated slitting blades 44 and paired anvils 45. The pairs of perforated slitting blades and anvils can be adjustable relative to one another to control perforation strength, as well as have a 0.0 to 0.5 degree or greater cant angle to improve cutting, if desired. The cant angle is defined as 43 in FIG. 4A, which is the angle between the longitudinal axis 44*b* of the perforated slitting blade 44 and the longitudinal axis 45*b* of anvil 45. Perforated slitting blade 44 could be formed by grinding notches into a sheer slitting blade or by notching a sheer slitting blade using an EDM (electric discharge machining) process, as well as by other techniques known to those of skill in the art for making a perforated slitting blade or structure. The perforated slitting blades and anvils can be made of hardened tool steel or similar materials. In addition to varying the overlap between the slitting blade and the anvil to control perforation strength, various configurations and dimensions can be used for the notches for the perforated slitting blades, such as a v-shaped notch measuring 0.040 inch wide and being 0.080 inch deep.

As seen in FIGS. 4 and 4A, slitting blade 44 is capable of producing first-type weakened zones with a first-type blade portion 46, and second-type weakened zones with second-type blade portion 47. Portion 47 may be variously placed about the perimeter of blade 44, and there may be one or more portion 47, as desired, and in part dependent upon the length of the wipes to be formed. For example, positioning three portions 47 at evenly placed locations around the circumference of blade 44 when the length of three wipes is slightly greater than the circumference can provide that several, and up to all, of the wipes produced will have at least one randomly positioned second-type weakened zone along the weakened line 24 between two adjoining wipes.

The perforated shear slitting blades could all be mounted on a common shaft (not shown) through a center hole 44*a* provided they do not have a cant angle, and mounted out of registration with each other. Alternatively, some or all of them could be separately supported, each by means known to those of skill in the art, and would be out of registration with each other most of the time but would not have to always be so. Similarly, the anvils could all be mounted on a common shaft (not shown) through a center hole 45*a* or some or all of them could be separately supported, each by means known to those of skill in the art. FIG. 4A shows a portion of an anvil shaft 48 for shear slitting where there would not be the need for individual anvils 45, or how multiple anvils 45 could be mounted side by side along a common shaft. As such, an annular recess 49 would be needed opposite each perforated shear slitting blade. An example of an apparatus that could be readily employed to operate as the slitter assembly 40, in combination with the teachings herein and that of one of ordinary skill in the art, is disclosed in U.S. Pat. No. 4,570,518 of inventors Burmeister et al. of assignee Kimberly-Clark Corporation, and which is incorporated herein by reference. Other examples of slitter or cutter apparatus for use as the slitter or cutter assembly here are seen in U.S. Pat. Nos. 4,721,295 and 4,700,939 both of inventor Hathaway and of assignee Kimberly-Clark Corporation, and which are each incorporated herein by reference. Additionally or alternately, the slitter assembly could be like that sold by the Tidland Corporation of P.O. Box 1008, Camas, Wash., under the tradename Tidland™ Series C Class II Knifeholder, with slitter blades of Tidland™ part # 129839 crush cut (with notches ground in), 128401 shear cut (with notches ground in), and 133508 anvil slitter. It should be understood that other techniques and structures known to those of skill in the art for making a weakened line in a web of material could also be used to practice the invention, in combination with the teachings herein. The particular technique and structure used is not critical to the invention as long as the employed technique and structure can make the desired weakened line in the web of material as taught herein.

Referring generally to the figures now, the group of sheets or wipes 22, such as a stack 10 of sheets, can include any suitable number of individual sheets depending upon the desired packaging and end use. For example, the stack 10 can be configured to include at least about 5 wet wipes and desirably from about 16 to about 320 individual sheets, and more desirably from about 32 to about 160 sheets. The size and shape of the stack of sheets 22 is dependent upon the size and shape of the package/dispenser and vice versa. For example, the length of an assembled stack of wet wipes sheets can be about 190 mm, with a height of about 90 mm and a width of about 100 mm.

Each sheet is generally rectangular in shape and defines a pair of opposite side edges and a pair of opposite end edges which can be referred to as a leading end edge and a trailing end edge. Each sheet defines an unfolded width and an unfolded length. The sheets can have any suitable unfolded width and length. For example, sheets of wet wipes can have an unfolded length of from about 2.0 to about 80.0 centimeters or from about 10.0 to about 26.0 centimeters and an unfolded width of from about 2.0 to about 80.0 centimeters or from about 10.0 to about 45.0 centimeters.

Materials suitable for the sheets of the present invention are well known to those skilled in the art. The sheets can be made from any material suitable for use as a wipe, including meltblown, coform, airlaid, bonded-carded web materials, spunlace, hydroentangled materials, high wet-strength tissue and the like and can comprise synthetic or natural fibers or combinations thereof. For wet wipes, they can have a dry basis weight of from about 25 to about 120 grams per square meter or from about 40 to about 90 grams per square meter.

In a particular aspect, sheets of wet wipes of the present invention can comprise a coform basesheet of polymeric microfibers and cellulosic fibers having a basis weight of from about 60 to about 100 grams per square meter or about 80–85 grams per square meter. Such coform basesheets can be manufactured generally as described in U.S. Pat. No. 4,100,324 to Anderson et al. which issued Jul. 11, 1978, and which is herein incorporated by reference. More particularly, such coform basesheets can be manufactured as are described as part of filed U.S. patent application Ser. No. 09/751,329, filed on Dec. 29, 2000 entitled, "Composite Material With Cloth-like Feel" of inventors Scott R. Lange et al. and also known as WO 02/053365, and which is incorporated herein by reference. Typically, such coform basesheets comprise a gas-formed matrix of thermoplastic polymeric meltblown microfibers, such as, for example, polypropylene microfibers, and cellulosic fibers, such as, for example, wood pulp fibers. The relative percentages of the polymeric microfibers and cellulosic fibers in the coform basesheet can vary over a wide range depending on the desired characteristics of the wet wipes. For example, the coform basesheet can comprise from about 20 to about 100 weight percent, from about 20 to about 60 weight percent, or from about 30 to about 40 weight percent of polymeric microfibers based on the dry weight of the coform basesheet being used to provide the wet wipes. An example of such a coform basesheet for use in the present invention is found in the baby wipes product presently sold by Kimberly-Clark Corporation and known as HUGGIES® Natural Care.

In another aspect of the invention, wipes 22 can contain a liquid which can be any solution which can be absorbed into the wipes, thus making them "wet wipes." The wipes can be moistened at any time before the wipes are actually used by the consumer. They can be moistened some time during the manufacturing process before or contemporaneous with the plurality of wipes being sealed in a dispenser or other packaging for next use by a product user. The liquid contained within the wet wipes can include any suitable components which provide the desired wiping properties. For example, the components can include water, emollients, surfactants, preservatives, chelating agents, pH buffers, fragrances or combinations thereof. The liquid can also contain lotions, ointments and/or medicaments. An example of such a liquid for use in the present invention is found in the baby wipes product presently sold by Kimberly-Clark Corporation and known as HUGGIES® Natural Care.

The amount of liquid or solution contained within each wet wipe can vary depending upon the type of material being used to provide the wet wipe, the type of liquid being used, the type of container being used to store the stack of wet wipes, and the desired end use of the wet wipe. Generally, each wet wipe can contain from about 25 to about 600 weight percent or from about 200 to about 400 weight percent liquid based on the dry weight of the wipe, for improved wiping in certain situations. To determine the liquid add-on, first the weight of a just-manufactured dry wipe is determined. Then, the amount of liquid by weight equal to the weight of the just-manufactured dry wipe, or an increased amount of liquid measured as a percent add-on based on the weight of the just-manufactured dry wipe, is added to the wipe to make it moistened, and then known as a "wet wipe" or "wet wipes". In a particular aspect wherein the wet wipe is made from a coform material comprising from about 30 to about 40 weight percent polymeric microfibers based on the dry weight of the wipe, the amount of liquid contained within the wet wipe can be from about 250 to about 350 weight percent or about 330 weight percent based on the dry weight of the wet wipe. If the amount of liquid is less than the above-identified range, the wet wipes can be too dry and may not adequately perform depending on the intended use. If the amount of liquid is greater than the above-identified range, the wet wipes can be over saturated and soggy and the liquid can pool in the bottom of the container, as well as contribute to problems with the adhesive 92 sticking to the surface of wet wipe sheets 22.

The plurality of sheets 22 of the present invention, e.g., wet wipes, can be arranged in a package or dispenser in any manner which provides convenient and reliable one at a time dispensing, and for wet wipes which assists the wet wipes in not becoming overly dry. An example of non-rigid containers for use with the present invention are disclosed in U.S. Ser. No. 09/813,536, filed Mar. 21, 2001 and entitled "STORAGE AND DISPENSING PACKAGE FOR WIPES" and assigned to the assignee of the present application also known as WO 02/058524, which prior application is incorporated fully herein by reference. FIGS. 5 and 6 show one such storing and dispensing pop-up wipes system 240 for wipes or sheets 22. The system 240 includes a non-rigid container 242 having sides 250 with a top end portion 252 and a bottom end portion 254, where the sides and top and bottom end portions define a cavity 256 within the container 242.

The cavity 256 includes a storage portion 258 for wipes 22. The top end portion 252 can include a resealable mechanism 200. A non-rigid baffle structure 210 has a width and is located in between the resealable mechanism 200 and the storage portion 258 with the baffle structure 210 positioned between opposing sides 250 of the container spaced apart from each other. The baffle structure thereby defines a dispensing portion 260 of the cavity 256 overlying the storage portion 258 of the cavity. As seen in FIG. 11, the resealable mechanism 200 is in a sealed closed position 202, whereas in FIG. 12 it is in an open position with a wipe 22 inside the container ready for pop-up dispensing. The mechanism 200 can be any type of mechanism that allows the package 240 to be opened, closed and reopened multiple times during the life of the package, e.g., a zipper with or without a stopper, resealable adhesive, a clip or other structure that achieves the result desired here.

In use, the resealable mechanism 200 is opened and then access to the dispensing portion 260 is gained. The user then passes his or her hand, etc., through the restrictive orifice 280 to grab the first wipe in the stack of wipes. If the orifice has a frangible seal, this must be broken before the user can pass his or her hand through the orifice. Once the user grabs the wipe, it can then pass through the restrictive orifice and enter the dispensing portion 260 as the user pulls it up. If the user does not immediately need the wipe, it can be left in the orifice partially dispensed where it can be maintained in place by the baffle structure 210 until desired later. The partially dispensed wipe will just rest in place in the orifice, part in the dispensing portion and part in the storage portion, conveniently ready for later dispensing in the pop-up format. If the user does immediately desire to use the wipe, it can pass the complete wipe through the dispensing portion and out of the package. For pop-up dispensing, the wipe will become separated or disjointed from the subsequent adjacent second wipe at a separably joined interface (e.g., weakened line, adhesive joint, or other mechanism) after fully dispensing the first wipe and while a portion of the second wipe remains in the opening or restrictive orifice 280. The next wipe for dispensing may be automatically maintained in the orifice partially dispensed for later use (i.e., in a pop-up dispensing format). Alternatively, the following wipe may need to be fetched out of the storage portion similar to the first wipe at a later time when it is desired, commonly called reach-in dispensing, if the user pushed the following wipe back into the storage portion after pop-up dispensing of the leading wipe. In either case, after the desired number of wipes are taken, the resealable mechanism can be sealed closed, with or without a wipe partially dispensed in the dispensing portion, as discussed previously. At a later time when another wipe(s) is desired, the preceding steps can generally be followed again. In this regard, the user can pull a subsequent third wipe through the dispenser opening and then separating the third wipe from a subsequent adjacent fourth wipe at a separably joined interface between the third and fourth wipes. Depending on the number of sheets in a clip and where in the stack dispensing is occurring, the separably joined interface can be a different type of separably joined interface than that of the previously separated first and second wipes. It should be understood that reference here to first, second, third and fourth wipes or sheets does not mean only sequential sheets one, two, three, and four (i.e., though it can refer to these also), but rather, such is used for reference purposes to refer to different sheets within a clip or stack of sheets and in relation to when in time such sheets are dispensed relative to one another.

An example of rigid containers suitable for use with the present invention are disclosed in U.S. Ser. No. 10/050,801 filed Dec. 19, 2001 entitled "PACKAGE AND METHOD FOR STORING AND DISPENSING WET WIPES IN A POP-UP FORMAT" and assigned to the assignee of the present application and also known as WO 03/053203, which prior application is incorporated fully herein by reference. FIG. 7 shows such a rigid plastic wet wipe pop-up wipes system 300. System 300 includes a top 301 hingedly attached to a base 302 and a mini-lid 303 hingedly attached to the top. The top contains a pop-up style wipe dispenser including a rigid port 305 which surrounds a flexible, rubber-like material or sheet 306 having a restrictive orifice type of dispensing opening 307. The dispensing opening 307 is illustrated as a continuous slit through which individual wet wipes are removed from the container. The cover is removably secured to the sidewalls of the base by a small lip around the periphery of the inner cover that engages notches with several protruding ribs on the inner surface of the sidewalls (not shown). The top is secured in a closed position onto the base by a suitable latching mechanism, and similarly so to is the mini-lid onto the top. The shape of the rigid port in the embodiment shown in FIG. 7 is straight slit, but can be any shape and size large enough to enable the user to reach into the container with their fingers to grasp the next available wet wipe in the event of a dispensing failure, or if reach-in dispensing is preferred to further aid in moisture retention of the wipes. A zigzag type slit as in WO 03/053203, supra, could. be used, for example. Generally, use of system 300 for dispensing wipes 22 is similar to that for system 240, except when due to obvious structural differences.

Figure 9:
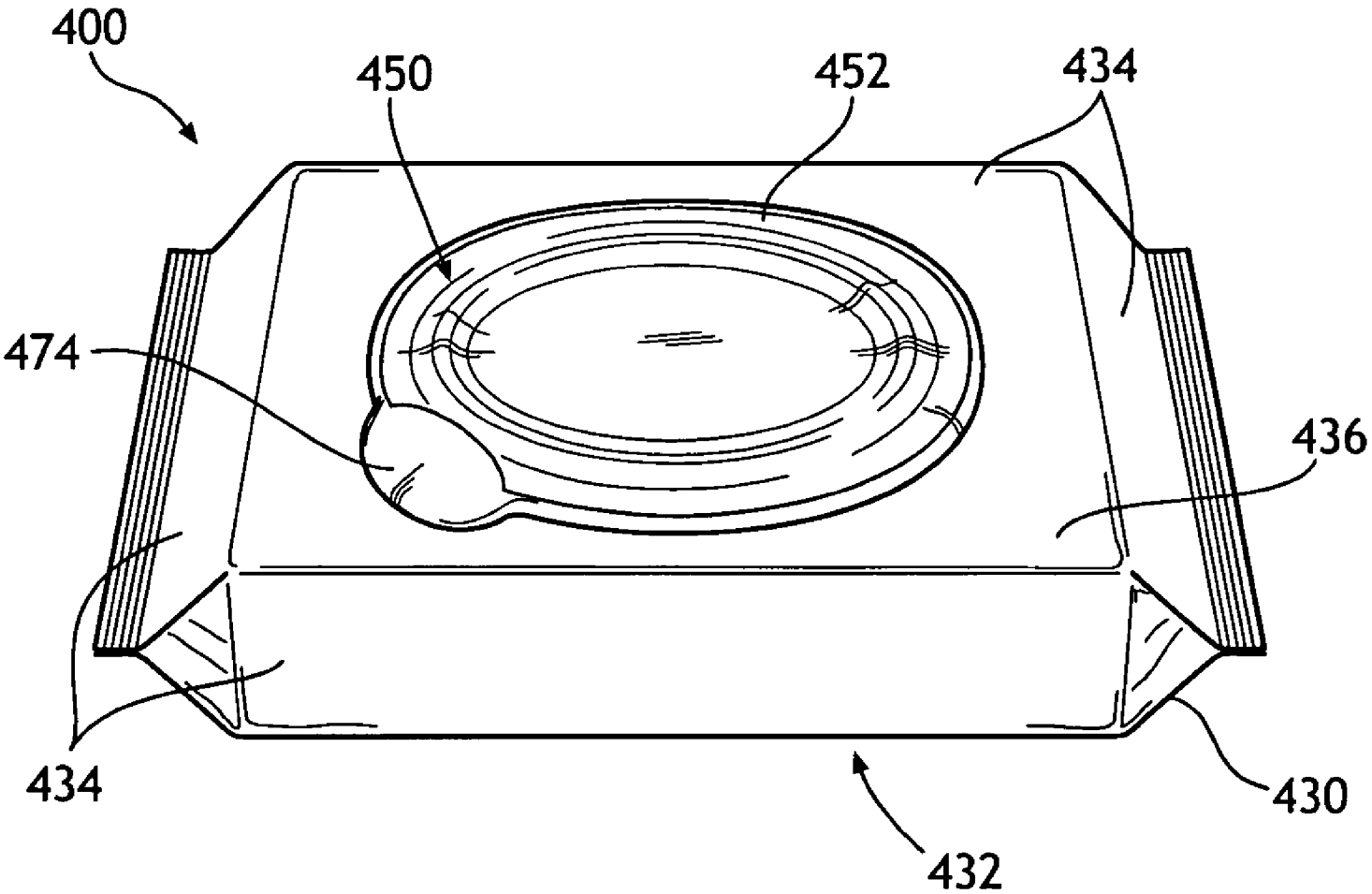
FIG. 9 representatively shows a perspective view of a type of dispenser which is part non-rigid and part rigid, for use with wipes of the present invention, where wipes are sealed therein and the dispenser top is closed.

An example of rigid and non-rigid container suitable for use with the present invention is disclosed in U.S. Provisional Application No. 60/487,695 filed on Jul. 15, 2003 entitled "STORING AND DISPENSING CONTAINER FOR PRODUCT" and assigned to the assignee of the present application, which prior application is incorporated fully herein by reference. FIG. 9 shows such a system 400. The container generally includes a flexible pouch 430 for storing product 22 and a rigid flip top 450 for dispensing the product and then resealing the container. The pouch includes a bottom portion 432 with side portions 434 adjoined to the bottom portion and each side portion adjoined to an adjacent side portion and the side portions extending away from the bottom portion. The top portion 436 includes a removable portion (not shown) which seals the product within the pouch in a first condition and which allows access to the product within the pouch in a second condition (i.e., when the removable portion is removed and the rigid flip top 450 is in an open condition. The rigid flip top 450 includes a lid 452 connected to a flange (not shown) by a hinge (not shown), and a tab 474 to assist in opening the lid and separating it from the flange when in the sealed condition. The flange is affixed to an outer surface of the pouch at the top portion 436 of the pouch such that the rigid flip top overlies the removable portion of the pouch and the removable portion is surrounded by the rigid flip top at the outer surface of the pouch. The flange forms a dispensing orifice through which the wipes can be dispensed when the lid is opened. The lid 452 is removably positonable to be closed (e.g., as seen in FIG. 9) to engage the flange and thereby seal the pouch at the outer surface where the removable portion is surrounded by the rigid flip top, and in this way seal the pouch and product therein from the environment outside the pouch after the removable portion is removed and no further wipes are desired during a particular dispensing occasion. Generally, use of system 400 for dispensing wipes 22 is similar to that for system 300, except when due to obvious structural differences.

All publications, patents, and patent documents cited in the specification are incorporated by reference herein, as though individually incorporated by reference. In the case of any inconsistencies, the present disclosure, including any definitions herein, will prevail. While the invention has been described in detail with respect to the specific aspects thereof, it will be appreciated that those skilled in the art, upon attaining an understanding of the foregoing, may readily conceive of alterations to, variations of, and equivalents to these aspects which fall within the spirit and scope of the present invention, which should be assessed accordingly to that of the appended claims.

I claim:

1. A group of wipes comprising:

at least three wipes separably joined together, each wipe separable joined to each adjacent wipe by a weakened line; and, each weakened line including a plurality of first-type weakened zones and at least one second-type weakened zone, wherein the second-type weakened zone has a length that is at least 1.5 times a length of the first-type weakened zone and the second-type weakened zone is randomly positioned along the weakened line such that no two consecutive weakened lines have the second-type weakened zone in the same position relative to opposite ends of consecutive weakened lines.

2. The group of wipes of claim 1 wherein the weakened line comprises perforations.

3. The group of wipes of claim 1 wherein the weakened line is a straight line.

4. The group of wipes of claim 1 wherein the group of wipes is formed into a stack of wipes.

5. The group of wipes of claim 4 wherein the stack of wipes comprises at least two clips of fan folded material, each clip comprising the group of wipes formed into a plurality of fan folded sheets with each sheet joined to at least one adjacent sheet by the weakened line, and each clip joined to an adjacent clip by a sheet of one clip being separably joined with a sheet of a succeeding clip.

6. The group of wipes of claim 4 wherein the stack of wipes comprises a fan folded stack of wipes.

7. The group of wipes of claim 1 wherein the group of wipes is formed into a roll of wipes.

8. The group of wipes of claim 1 further comprising a liquid in combination with the group of wipes with the liquid at an add-on rate of about 25 to about 600 weight percent based on a dry weight of the group of wipes.

9. A group of wipes for use in a pop-up wipes system comprising:

a pop-up dispenser having a restrictive orifice through which wipes can be dispensed;

at least three wipes separably joined together, each wipe separable joined to each adjacent wipe by a weakened line; and, each weakened line including a plurality of first-type weakened zones and at least one second-type weakened zone, wherein the second-type weakened zone has a length that is at least 1.5 times a length of the first-type weakened zone and the second-type weakened zone is randomly positioned along the weakened line such that no two consecutive weakened lines have the second-type weakened zone in the same position relative to opposite ends of consecutive weakened lines.

10. The group of wipes of claim 9 wherein the weakened line comprises perforations.

11. The group of wipes of claim 9 wherein the weakened line is a straight line.

12. The group of wipes of claim 9 wherein the group of wipes is formed into a stack of wipes.

13. The group of wipes of claim 12 wherein the stack of wipes comprises at least two clips of fan folded material, each clip comprising the group of wipes formed into a plurality of fan folded sheets with each sheet joined to at least one adjacent sheet by the weakened line, and each clip joined to an adjacent clip by a sheet of one clip being separably joined with a sheet of a succeeding clip.

14. The group of wipes of claim 9 wherein the group of wipes is formed into a roll of wipes.

15. The group of wipes of claim 9 further comprising a liquid in combination with the group of wipes, the liquid at an add-on rate of about 25 to about 600 weight percent based on a dry weight of the group of wipes.

16. A process for making the group of wipes of claim 1, comprising:

providing an elongate web of material;

weakening the elongate web of material along a plurality of lines to define a plurality of panels consecutively releasably joined together by a weakened line;

forming the weakened line relative to at least three wipes separably joined together by respective weakened lines such that the weakened line between the adjoining wipes includes a plurality of first-type weakened zones and at least one second-type weakened zone, wherein the second-type weakened zone has a length that is at least two times a length of the first-type weakened zones and the second-type weakened zone is randomly positioned along the weakened line such that no two consecutive wipes of the group have weakened lines with the second-type weakened zone in the same position relative to opposite ends of the weakened lines of consecutive wipes.

17. The process claim 16 comprising forming the group of wipes into a fan folded clip of wipes.

18. The process of claim 17 comprising forming a stack of wipes, the stack of wipes comprising at least two clips of fan folded material, each clip comprising the group of wipes formed into a plurality of fan folded sheets with each sheet joined to at least one adjacent sheet by the weakened line, and each clip joined to an adjacent clip by a sheet of one clip being separably joined with a sheet of a succeeding clip.

19. The process of claim 16 further comprising adding a liquid to the group of wipes, the liquid at an add-on rate of about 25 to about 600 weight percent based on a dry weight of the group of wipes.

* * * * *